US009169038B2

(12) United States Patent
Steiner

(10) Patent No.: US 9,169,038 B2
(45) Date of Patent: Oct. 27, 2015

(54) TRANSPORT CONTAINER MADE FROM LIGHTWEIGHT CONSTRUCTION BOARDS

(71) Applicant: Peter Steiner, Bretten (DE)

(72) Inventor: Peter Steiner, Bretten (DE)

( * ) Notice: Subject to any disclaimer, the term of this patent is extended or adjusted under 35 U.S.C. 154(b) by 0 days.

(21) Appl. No.: 14/252,331

(22) Filed: Apr. 14, 2014

(65) Prior Publication Data

US 2014/0306001 A1 Oct. 16, 2014

(30) Foreign Application Priority Data

Apr. 16, 2013 (DE) ..... 10 2013 006 492

(51) Int. Cl.

| | |
|---|---|
| ***B65D 5/20*** | (2006.01) |
| ***B65D 21/02*** | (2006.01) |
| ***B65D 6/24*** | (2006.01) |
| ***B65D 8/00*** | (2006.01) |

(52) U.S. Cl.

CPC ..... *B65D 5/20* (2013.01); *B65D 11/1873* (2013.01); *B65D 15/22* (2013.01); *B65D 21/0213* (2013.01)

(58) Field of Classification Search

USPC ..... 217/13, 43 R, 45; 229/919, 165

See application file for complete search history.

(56) References Cited

U.S. PATENT DOCUMENTS

| | | | | |
|---|---|---|---|---|
| 1,317,836 | A | 10/1919 | Townsend | |
| 5,741,042 | A * | 4/1998 | Livingston et al. | 296/203.01 |
| 8,499,954 | B2 * | 8/2013 | Tang | 220/4.01 |

FOREIGN PATENT DOCUMENTS

| | | | |
|---|---|---|---|
| AT | 7 002 | U1 | 7/2004 |
| DE | 39 34 800 | A1 | 5/1990 |
| DE | 295 17 978 | U1 | 1/1996 |
| EP | 0 432 053 | A1 | 6/1991 |
| EP | 1 505 001 | A1 | 2/2005 |

OTHER PUBLICATIONS

European Search Report mailed Aug. 1, 2014 by the European Patent Office and issued in a related Application No. 14000844.2-1708, (6 pages).

The Examination Report mailed Nov. 13, 2013 by German Patent Office and issued in a related DE Patent Application No. DE 10 2013 006 492.9, filed Apr. 16, 2013 (5 pages).

* cited by examiner

*Primary Examiner* — Christopher Demeree

(74) *Attorney, Agent, or Firm* — Carter, DeLuca, Farrell & Schmidt, LLP; Robert P. Michal, Esq.

(57) ABSTRACT

A transport container made from lightweight construction boards, having a base and upright walls extending around the base. In order to manufacture the transport container in a more cost-effective, more rugged and more easily reparable manner, the walls, at their lower end, have a flap which extends along the edge of the walls and is angled in the direction of the base and which is connected to the base. Wherein an upwardly curved channel is between the angled flap and the edge, and the walls, at their upper end, have an upwardly curving beading which has a shape which corresponds to the channel at the lower end of the walls. In order to obtain improved stability, the transport container, which is constructed in a modular manner, may be provided with a concealed frame of metal tubes.

10 Claims, 1 Drawing Sheet

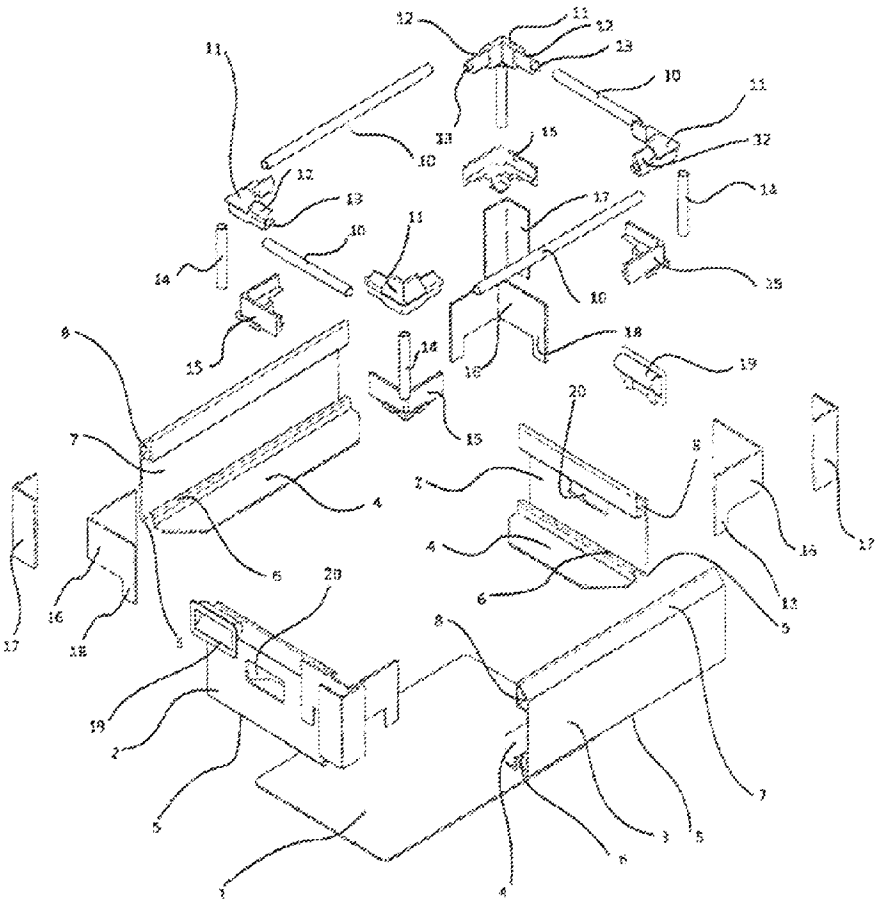

TRANSPORT CONTAINER MADE FROM LIGHTWEIGHT CONSTRUCTION BOARDS

CROSS-REFERENCE TO RELATED APPLICATION

This application claims priority under 35 USC 119 of German Patent Application Serial No. DE 10 2013 006 492.9 filed Apr. 16, 2013, the entire disclosure of which is incorporated herein by reference.

BACKGROUND INFORMATION

The invention relates to a transport container made from lightweight construction boards, having a base and having upright walls extending around the latter.

Containers of this type, in their two-dimensional components, substantially consist of flat blanks, e.g. corrugated board or comparable plastic laminates, twin-wall sheets, etc. Lightweight boards made of polypropylene, which are particularly suitable, are commercially available, for example under the trade name CON-Pearl. In the case of this material, the center layer is deformed in a three-dimensional manner and laminated on both sides with a smooth plastic layer.

It is known here to provide lightweight boards of this type, made of plastic, with creases which are incorporated in a thermal manner and form hinges, fold lines, etc. In the prior art, transport containers with their base and their walls, for example, are cut to size in one piece from lightweight boards, and the walls are then folded upward at these creases.

In the case of such transport boxes manufactured in a one-piece manner it is disadvantageous that, on the one hand, the blanks cause a comparatively large amount of offcuts and, on the other hand, such transport boxes, in the case of any damage, cannot be repaired or can be repaired only with difficulty and, therefore, have to be disposed of completely. This is seen as a disadvantage in terms of cost.

A further disadvantage can be seen in that the stability and/or ruggedness of the transport containers is determined by the strength, or thickness, of the material. Therefore, rugged transport containers are usually made from stronger, i.e. thicker, material and, therefore, have a higher weight.

An essential aspect in the case of transport containers of this type, which are used e.g. to transport components from an automotive supplier to an automotive manufacturer, is the stackability of said transport containers. It is important here that a corresponding transport container can not only hold its contents but also may have a plurality of other transport containers loaded on top, without collapsing under such a load. In order to have the ruggedness required therefor, transport containers having thick walls are manufactured, which, therefore, have a higher weight which, in the case of a permissible total weight at which a transport container is still manually manageable, has a disadvantageous effect on the weight which is available for the contents of the transport container.

SUMMARY

It is thus an object of the present invention to improve a transport box as mentioned above in such a manner that said transport box avoids the stated disadvantages.

This object is achieved according to the invention in that the walls of the transport container, at their lower end, have a flap which extends along the edge of the wall and is angled in the direction of the base and, which is to be connected to the base, wherein an upwardly curved channel is between the angled flap and the edge, and in that the walls of the transport container, at their upper end, have an upwardly curving beading which has a shape which corresponds to the channel at the lower end of the wall. The beading and channel thus have about the same cross-section.

The advantage of the invention consists in particular in that a transport container having very rugged walls and which, moreover, can be assembled from a plurality of individual parts is manufacturable with this type of construction. It is, in particular, provided here to separately produce the walls and the base, and to then connect the base to the walls via the flaps. As a result, these individual parts may each be smaller, such that a smaller amount of offcuts are obtained when cutting to size.

Moreover, such a construction has the advantage that, in the case of any damage to an individual part, only that individual part can be replaced. Such a transport container is, therefore, much easier to repair, on account of which a considerable cost advantage results.

The channel, which is formed at the lower end of a wall between the angled flap and the wall, has its substantial advantage in the interaction with a beading having a corresponding shape and/or cross-section when two transport boxes are placed on top of one another. The upwardly curving beading custom-fits into the upwardly curving channel of the transport container standing on top. It is prevented in this manner that the lower wall bulges in the case of a load acting on it, since the wall, at its upper end, is stabilized, in particular in the transverse direction of the wall, by the beading sitting in the channel situated thereabove.

The engagement of the beading in an upwardly curving channel lying above has also the advantage that, when two transport containers are placed on top of one another, an upwardly running joint is formed at this point, which joint can prevent e.g. the incursion of water, in particular splash water, such as can occur in the case of rain, into the interior of the transport container.

In a particularly preferred embodiment, the edge at the lower end of the side wall, which is adjoined by the upwardly curving channel, forms a contact element for the transport container. Said edge is, thus, the lowest point of the transport container and here, in particular, is configured in a linear manner. It is, however, also within the scope of the invention if the contact element is configured to be wider and thus forms a contact face instead of only a contact line.

This embodiment has the advantage that forces which are introduced from above into the wall and which e.g. originate from the weight of a further transport container which has been placed on top of a transport container can be dissipated directly downward in a straight path and do not have to be routed via a bending which could kink under excessive load and thus buckle. Therefore, this construction leads to improved ruggedness of the transport container.

It is within the context of the invention when the beading, which is provided at the upper end of a wall, is integrally formed, and in particular formed by way of edge bending, on the wall, wherein the material is edge-bent several times such that the beading, in the interior, forms a hollow chamber.

This construction is readily manufacturable using established production methods and, overall, leads to a rugged upper edge of a transport container according to the invention.

In one particularly preferred embodiment of the invention, an in particular metallic reinforcement, e.g. in the form of an aluminum tube, is inserted into the hollow interior of the mentioned chamber.

The use of a corresponding reinforcement leads to a further improvement of ruggedness.

Here, aluminum tubes are a semi-finished product which is available at economical pricing. However, glass-fiber reinforced plastic tubes are also conceivable as alternatives.

On account of the insertion of tubes, it is possible overall to facilitate recyclability of the transport containers at a later stage, while maintaining simple separation of materials.

For connecting the walls to one another, it is proposed to use edge elements, made from plastic or from lightweight boards also used elsewhere, which are provided on their sides with nose pieces which are pluggable between the flap, which is angled at the lower end of a all, and the beading, which is formed at the upper of the wall. This leads to a rigid connection which, on the one hand, increases the ruggedness of the transport container and, on the other hand, also makes it possible to first assemble the edge elements and to subsequently adhesively bond them into position.

In order to stiffen in an overall manner the upper periphery of a transport container according to the invention, it is proposed to provide the upper corners of the transport container with angle pieces which are provided with projections which engage in the chambers at the upper ends of the side walls. Angle pieces of this type, as prefabricated components, can also be used to achieve a desired fixation of the reinforcements provided in these chambers.

It is viewed as particularly advantageous that the angle pieces, on their upper side, are provided with sliding grooves which correspond in their shape to the contact elements at the lower ends of the side walls. When two transport containers are placed on top of one another, it is thus made possible to let the upper one slide in a guided manner on the lower one. An undesirable lateral sliding away of the upper transport container, which could lead to injuries to users, is reliably avoided by the engagement of the contact elements in the sliding grooves.

In a refinement of the transport container, the loads acting here on the angle pieces can also be guided onward to the lower side of the transport container via tubular pieces which run parallel, that is to say substantially vertically, to the edges of the abovementioned edge elements and with which the angle pieces are connected to fixtures which are mounted at the lower end of the edge elements.

The mentioned tubular pieces, with the abovementioned reinforcements which are provided in the chambers formed by the beading on the upper end of the walls, thus form a type of stabilizing basic frame for a transport container which is particularly resilient to heavy loads.

The angle elements and the mentioned fixtures here may also be connected via the tubular pieces in a twist-proof manner, which further increases the ruggedness of the transport containers.

Further advantages and features of the invention are derived from the following description of an exemplary embodiment.

BRIEF DESCRIPTION OF THE DRAWING

The FIGURE shows a transport container according to the invention in a perspective exploded view.

DETAILED DESCRIPTION

A base 1, having four upright walls 2, 3 extending around it, can be identified. In the example illustrated here, the base 1 and the walls 2, 3 consist of lightweight construction boards in the form of twin-wall sheets of polypropylene.

On their lower ends, the walls 2, 3 have edge-bent flaps 4 which face the base 1 and, the assembled state of the transport container, connected to the latter e.g. by way of adhesive bonding.

The flaps 4 extend along the lower edges 5 of the walls 2, wherein upwardly curved channels 6 are configured between the horizontally lying two-dimensional flaps 4 and the substantially vertically running two-dimensional walls 2, 3. Said channels 6, in the example illustrated here, are manufactured in that the edge-bending of the two-dimensional material on the edges 5 is greater than 90° and the material is then edge-bent in opposite directions another two times, so as to then transition into the flaps 4.

The two further edge-bendings here are placed such that the edges 5 lie at the lowest point of the profile of the edge-bent wall material and, in this manner, form a contact element in the form of a contact line in the finished assembled transport container.

At their upper ends, the walls 2, 3 have a beading 7 which is upwardly curved and here forms the substantially same contour, or has the same shape, as the channel 6 at the lower end of the walls 2, 3.

In this manner it is possible to place two transport boxes on top of one another in a custom fit by means of their walls 2, 3 and the channels 6, which are situated on the bottom of said walls, and/or the beadings 7, which are situated on the top.

Since the channels 6, via the flaps connected thereto, are connected to the base 1, they are unable to evade forces which act upon them in a transverse manner, that is in a normal manner in relation to the planes formed by the walls 2, 3. They thus stabilize the beadings 7 which lie inside said channels and which are, therefore, unable to bulge in the case of forces acting on the walls, on account of which the loading capacity of transport containers which are placed on top of one another is significantly increased.

The beadings 7 are manufactured by a plurality of edge-bendings of the two-dimensional material of the walls 2, 3, such that the beading 7 in an overall manner represents a chamber 8 which, in the interior, is hollow. The beading 7 here is in each case integrally formed on the walls 2, 3.

Reinforcements 9, which in the example illustrated here consist of tubes, in particular aluminum tubes 10, may be inserted into the interior of the chamber 8.

In the example illustrated here, these tubes 10 interact with angle pieces 11 which, for this purpose, have projections 12, onto which the tubes 10, via pins 13 on their ends, are pluggable. At the same time, the angle pieces 11, with their projections 12, are pluggable into the chambers 8 of the beadings 7, such that an overall rugged unit is formed.

In a comparable manner, the angle pieces 11, on their lower sides, sit on tubular pieces 14 which run substantially vertically and, on their lower end, are connected to fixtures 15.

The fixtures 15 and the angle pieces 11 form the lower and/or the upper end in the corner region of the transport container, wherein the region in between is formed by edge elements 16 and by coverings 17 which interact with the former.

The edge elements 16, on their sides, here have nose pieces 18 which, in terms of their height, correspond to the clear distance on the inner side of the walls 2, 3 between the channel 6 and the beading 7. By insertion of the nose pieces 18 at this position, a form-fitting connection of the edge elements 16 and of the walls 2, 3 can be achieved. The edge elements 16 here sit on the inner side of the transport container. The covering 17 is then in particular adhesively bonded to said position on the outer side of the transport container.

It should be noted that the corner pieces 11, at their upper end, are provided with sliding grooves 11 through which the edges 5 of a second transport container, which is to be placed on or removed from a transport container, can slide, such that removing and/or placing are/is facilitated.

Lastly, reference is made to the shell-type handles 19 which are insertable into the recesses 20 provided therefor on the walls 2 and which facilitate handling of the assembled transport container.

The transport container illustrated and described here has the particular advantage of a modular construction. On the one hand, this makes repair possible in the case of any damage. On the other hand, a simple separation of materials is also possible at the end of the life cycle and, therefore, disposal when necessary of such a transport container via recycling is also simplified.

The invention claimed is:

1. A transport container made from lightweight construction boards, comprising a base and upright walls extending around the base, wherein the upright walls, at their lower end, have a flap which extends along a lower edge of the upright walls and is angled in the direction of the base and which is to be connected to the base, and wherein an upwardly curved channel is disposed between the flap and the lower edge of the upright walls, the upwardly curved channel being disposed above the lower edge of the upright walls, and in that the upright walls, at their upper end, have an upwardly curving beading which has a shape which corresponds to the channel at the lower edge of the upright walls, the lower edge of the upright walls forming a contact element for the transport container, and the lower edge of the upright walls, being the contact element, forms the lowest point of the transport container.

2. The transport container according to claim 1, wherein the upwardly curving beading is integrally formed on the upright wall by way of edge bending and forms a chamber which, in an interior thereof, is hollow.

3. The transport container according to claim 2, further comprising a reinforcement which is inserted into the interior of the chamber.

4. The transport container according to claim 1, further comprising edge elements, wherein the upright walls are connected by the edge elements which are provided with nose pieces which are pluggable between the flap, which is angled at the lower edge of the upright walls and the upwardly curving beading, which is formed at the upper end of the upright walls.

5. The transport container according to claim 1, wherein corners of said transport container, at a top end, are provided with angle pieces which, with projections, engage in chambers at the upper ends of the walls.

6. The transport container according to claim 5, wherein the angle pieces, on an upper side, have sliding grooves which correspond into their shape to the contact elements at the lower edge of the upright walls.

7. The transport container according to claim 5, wherein the angle pieces correspond with vertically running tubular pieces via which said angle pieces are connected to fixtures which grip the upright walls at the lower edge in corner regions.

8. The transport container according to claim 1, wherein the upwardly curved channel, which is disposed between the lower edge of the upright walls and the flap, comprises a first angled portion whose exterior angle is greater than 90 degrees.

9. The transport container according to claim 8, wherein the upwardly curved channel, comprises a second angled portion.

10. The transport container according to claim 9, wherein the upwardly curved channel, comprises a third angled portion.

* * * * *